US010889138B1

(12) United States Patent
Fry et al.

(10) Patent No.: US 10,889,138 B1
(45) Date of Patent: Jan. 12, 2021

(54) FOAM BOOK

(71) Applicant: Melissa & Doug, LLC, Wilton, CT (US)

(72) Inventors: Lyndall Carvell Fry, Wilton, CT (US); Ayokunle S. Adeniran, Roswell, NM (US)

(73) Assignee: Melissa & Doug, LLC, Wilton, CT (US)

( * ) Notice: Subject to any disclaimer, the term of this patent is extended or adjusted under 35 U.S.C. 154(b) by 0 days.

(21) Appl. No.: 16/566,780

(22) Filed: Sep. 10, 2019

(51) Int. Cl.
*B42D 1/00* (2006.01)
*A63H 33/38* (2006.01)

(52) U.S. Cl.
CPC ..... *B42D 1/008* (2013.01); *A63H 33/38* (2013.01); *B42P 2241/20* (2013.01)

(58) Field of Classification Search
CPC ..... B42D 1/008; A63H 33/38; B42P 2241/20
USPC ..... 40/726; 281/2, 3.1, 5, 15.1, 29; 283/63.1, 64
See application file for complete search history.

(56) References Cited

U.S. PATENT DOCUMENTS

| | | | | |
|---|---|---|---|---|
| 6,070,909 | A | 6/2000 | Kaufman | |
| 6,364,360 | B1 * | 4/2002 | Kaufman | A63H 33/38 281/15.1 |
| 6,390,507 | B1 | 5/2002 | Derraugh | |
| 6,712,396 | B2 | 3/2004 | Derraugh | |
| 2013/0049344 | A1 * | 2/2013 | Duparc | B42F 7/065 281/20 |

* cited by examiner

*Primary Examiner* — Justin V Lewis
(74) *Attorney, Agent, or Firm* — Wissing Miller LLP

(57) ABSTRACT

There is disclosed a book with a front cover formed by a front base layer and a front decorative layer. The front base layer has a first front face portion, a second front face portion, and a front free edge. The front decorative layer is disposed on the second front face portion. The book has a rear cover formed by a rear base layer and a rear free edge. A binding layer extends across the rear base layer and along the first face portion of the front base layer cover. The binding layer is adhered with the rear base layer and the first face portion so that the front decorative layer extends from the front free edge and across the second front face portion. An edge of the binding layer abuts an edge of the front decorative layer. This arrangement eliminates a free edge between along the front cover of the book. The book includes one or more pages disposed between the front and rear covers. The pages each include respective page base layers and each base layer including a page binding edge. The page binding edge is connected with the binding layer.

17 Claims, 5 Drawing Sheets

FOAM BOOK

BACKGROUND

Field

The present application relates to books formed from foam or other soft polymer materials and in particular to foam books with a construction that provides continuous surfaces between abutting layers of material on the outer surfaces of the book to improve the durability of the book and reduce the risk that material may be torn from the book.

Description of the Related Art

Foam materials, such as Ethylene Vinyl Acetate (EVA), provide a soft surface that is pleasing to the touch and is easily handled by young children. Such materials can be used to form play objects for children, including foam books.

Foam books are formed by assembling layers of foam materials, usually with layers formed from of various colors to create a pleasing and engaging visual appearance. The layers of foam are adhered to one another to create the covers, spine, and pages of the book.

One such book is described in U.S. Pat. No. 6,070,909. The book includes a front and back cover and a plurality of intervening pages, each formed from a foam material. A spine is created by providing a continuous sheet of paper or fabric extending from the free edge of the back cover, around the spine of the book and over the front cover to the free edge of the front cover. Pages are joined to the spine along the edge of the pages opposite the free edges of the pages. Because a single layer of foam forms the outer surfaces of the back and front of the book, if different colors for different parts of the outer surface of the book are desired, such, these colors must be applied to the layer of foam, for example, by printing.

U.S. Pat. Nos. 6,309,507 and 6,712,396 also describe foam books. These references describe books formed from multiple foam pages where the edges of the front and back covers as well as the edges of the pages are joined with a book binding portion along the spine of the book. The book binding portion may extend partially across the front and back covers, leaving a portion of the covers exposed. The exposed edges of the book binding portion may create an area where a child can grasp or bite on the book binding portion and tear it away from the cover, creating a potential choking hazard.

Other known foam books include front and back covers joined by a spine layer where the spine layer overlies the outside surfaces of the front and read covers. Such books include a raised edge where the spine layer overlies the covers. In some cases, this raised edge can be grasped by a user, for example, a child, and torn from the book. Such a torn piece my create a choking hazard.

SUMMARY

The present disclosure relates to books that are formed from multiple layers of a molded material such as foam that address these and other problems with known foam books.

According to one embodiment of the disclosure there is provided a foam book with a front and back cover and one or more pages dispose between the covers. A binding layer is provided that joins the front and back covers together and provides a surface to which edges of the pages are joined.

According to one embodiment, the binding layer extends across the back surface of the rear cover from the free edge of the rear cover, around the spine of the book and partially across the front surface of the front cover. A front decorative layer is provided on the front cover that abuts the edge of the binding layer and extends across the front surface to the free edge of the front cover. According to a further embodiment, the binding layer extends only partially across the back cover and a rear decorative layer covers the remainder of the rear cover and abuts the binding layer.

According to one embodiment, the abutting edges of the decorative layer and the binding layer have the same thickness and these two edges abut along a continuous edge. The abutting, equal-thickness edges reduce or eliminate an exposed edge along the book cover. Eliminating the exposed edge reduces the chance that a child can grasp a part of the foam and tear it away from the book.

According to a further embodiment, the binding layer and the decorative layer are formed from polymer materials with different colors. For example, the decorative layer may be formed from a polymer foam that includes a colorant that gives it a color that contrasts with the material forming the decorative layer. Foam materials, such as EVA foams are commercially available in a variety of colors, so a designer of a book formed according to an embodiment of the disclosure has a wide choice of colors to create a pleasing appearance. Moreover, since the colors of the binding and decorative layers are already provided in the foam material when purchased, a printing step to apply colors to different portions of the book is avoided. Foam materials are also commercially available with a variety of surface textures. By providing a binder layer and a decorative layer formed from different textured foam materials, a pleasing contrast of textures can be provided.

According to a further embodiment, printing, texturing, and die cutting steps can be applied to the foam layers before the book is assembled. For example, text, photographs, and other artwork can be applied to decorative layers that will form the front and rear covers before they are assembled into the book.

According to a further embodiment, removeable pieces may be formed on the covers and/or pages of the book, whereby shaped sections of foam are removably positioned on the covers or pages. These removable pieces can themselves be playthings and can be shaped to integrate with the artwork and text. For example, a book about ocean creatures can include removable foam pieces shaped like fish. According to a further embodiment, the cover and/or pages of the book are formed from multiple foam layers and the shaped, removable pieces are formed from less than all of the foam layers so that, when the removable piece is positioned in the opening on the cover or page, it cannot fall through the back of the cover or page.

According to a further embodiment, there is disclose a book comprising a front cover, wherein the front cover comprises a front base layer and a front decorative layer, wherein the front base layer comprises a first front face portion, a second front face portion, and a front free edge, and wherein the front decorative layer is disposed on the second front face portion. The book further comprises a rear cover, the rear cover having a rear base layer and a rear free edge and a binding layer, the binding layer extending across the rear base layer and along the first face portion of the front base layer cover, wherein the binding layer is adhered with the rear base layer and the first face portion, and wherein the front decorative layer extends from the front free edge and across the second front face portion and abuts the binding layer. The front cover may comprise a front core layer, the front core layer disposed between the front decorative layer and the front base layer. The rear cover may comprise a rear core layer, the rear core layer disposed between the rear base layer and the binding layer. The binding layer may have a first textured surface facing outward of the book and the front decorative layer may have a second textured surface facing outward of the book, and wherein textures of the first and second texture surfaces may be different.

According to a further embodiment the book comprises one or more pages disposed between the front and rear covers, the pages each including respective page base layers and each base layer including a page binding edge, wherein the page binding edge is connected with the binding layer. The binding layer may have a binding layer thickness where it extends along the first front face portion, wherein the front decorative layer has a front decorative layer thickness, and wherein the binding layer thickness is substantially equal to the front decorative layer thickness. The pages may further comprise a page surface layer and a page core layer, wherein the page core layer extends across a face of the page base layer, and wherein the page surface layer extends across a face of the page core layer opposite the page base layer. The page surface layer may be textured. One or more of the page core layer and the page surface layer may be connected to the binding layer along the page binding edge. The edges of the front cover, the rear cover, and the one or more pages may be aligned with one another.

According to one embodiment at least one page further comprises a cut region, the cut region formed through the page surface layer and page inner layer, wherein the cut region is removable from the page, and wherein the page base layer adjacent the cut region is intact, whereby the page base layer prevents the cut region from falling through the page. The cut region may be formed by a cut line extending continuously around the periphery of the cut region, wherein the cut line is formed by a plurality of linear regions, curvilinear regions, and combinations thereof. According to one aspect, the page surface layer has a surface layer thickness and wherein a minimum distance between the edge of the cut region and an edge of the page surface layer is greater than the surface layer thickness. Printing may be applied to the page base layer on a portion of the page base layer facing the cut region and wherein the cut region obscures the printing when the cut region is not removed. The page surface layer may have a first texture and the cut region may have a second texture, and wherein the first and second textures may be different.

The front cover, the rear cover, the binding layer, and the one or more pages may be formed from a foam material. The foam material may comprise an elastomer. The elastomer may be one or more of ethylene vinyl acetate (EVA), polyurethane, polyethylene, silicone, nitrile rubber, neoprene, and natural latex. The elastomer may be EVA foam with a Durometer hardness range of about 30 Shore OO to about 95 Shore OO.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

and

Figure 4A:
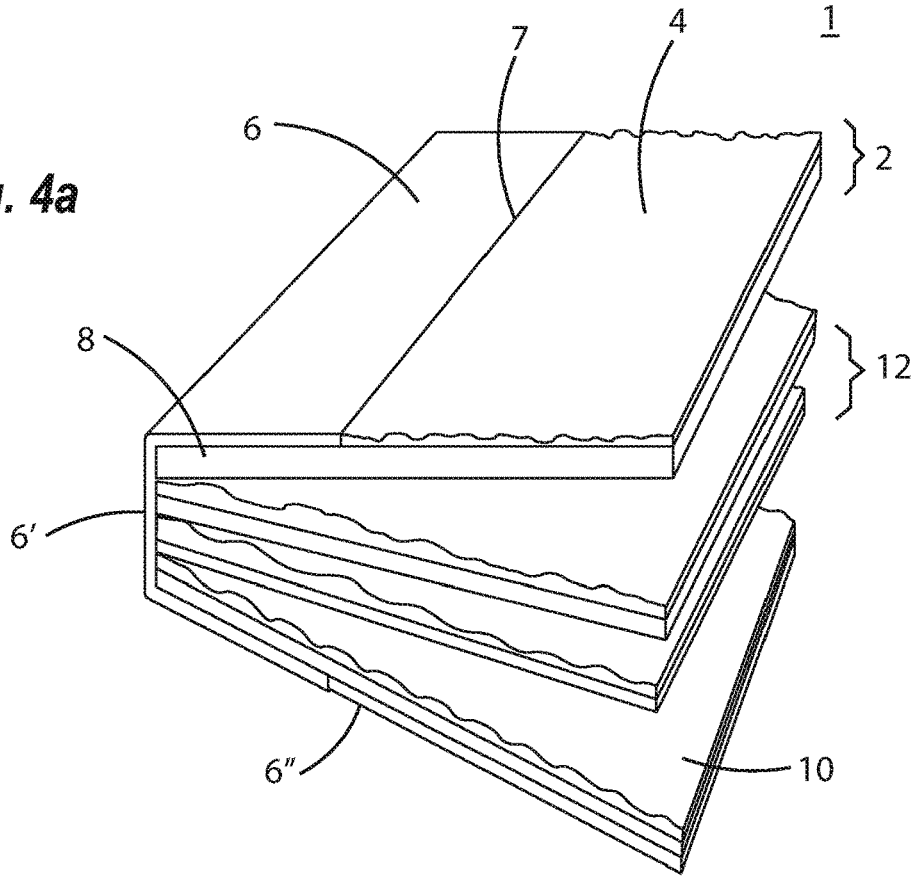
FIG. 4*a* shows a foam book according to an alternative embodiment of the disclosure.
Figure 4B:
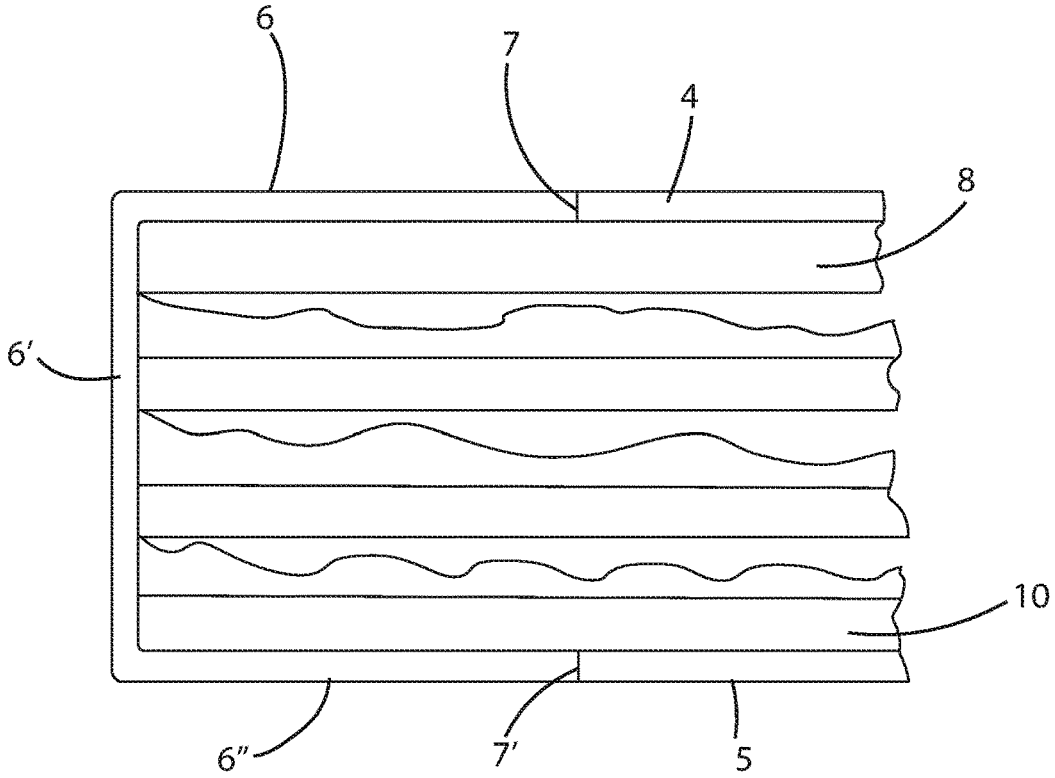

FIG. 4*b* shows a detailed view of the embodiment of FIG. 4*a.*

DETAILED DESCRIPTION

Figure 1A:
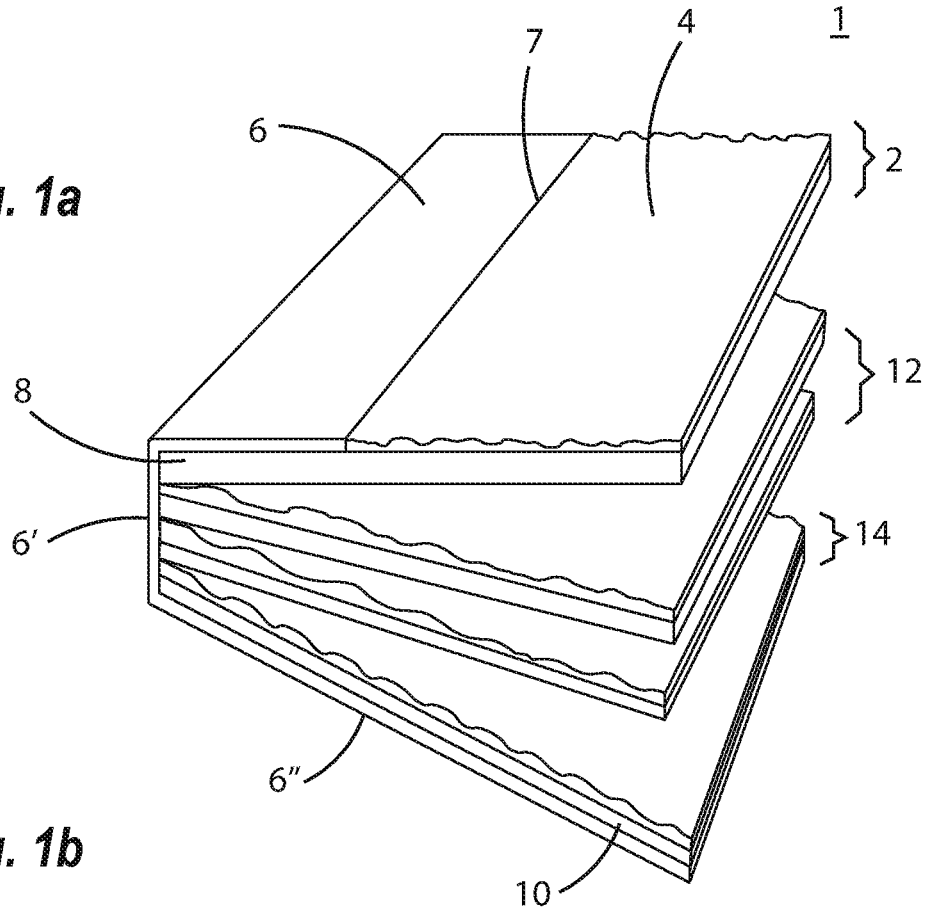
FIG. 1*a* is a perspective view of a foam book according to an embodiment of the disclosure.

FIG. 1*a* is a perspective view of a foam book 1 according to an embodiment of the disclosure. The book 1 is comprised of a front cover portion 2 and a rear cover portion 14. Between the covers 2, 14 are one or more pages 12. A binding layer 6 joins the front and rear covers and provides a spine portion 6' that is joined to an edge of each of the pages 12.

According to one embodiment, the components forming the book 1 are constructed from a polymer material. According to a more preferred embodiment, the polymer material is formed as a foam. The foam may be selected from one or more polymers including, but not limited to ethylene vinyl acetate (EVA), polyurethane, polyethylene, silicone, nitrile rubber, neoprene, natural latex, and the like. According to a most preferred embodiment, the polymer material is EVA foam. The foam material has a hardness preferably between about 30 Shore OO to 95 Shore OO. More preferably, the material is EVA foam with a 55 Shore C/85 Shore OO durometer hardness. EVA foam is easily colored by adding various colorants to provide an array of colors. EVA can be formed into sheets to create the various components of book 1, as described below. EVA foam sheets can be embossed with textures to provide an appealing tactile feel for the book. According to embodiments of the disclosure, different components of the book are formed from differently colored and/or textured foam material.

Figure 1B:
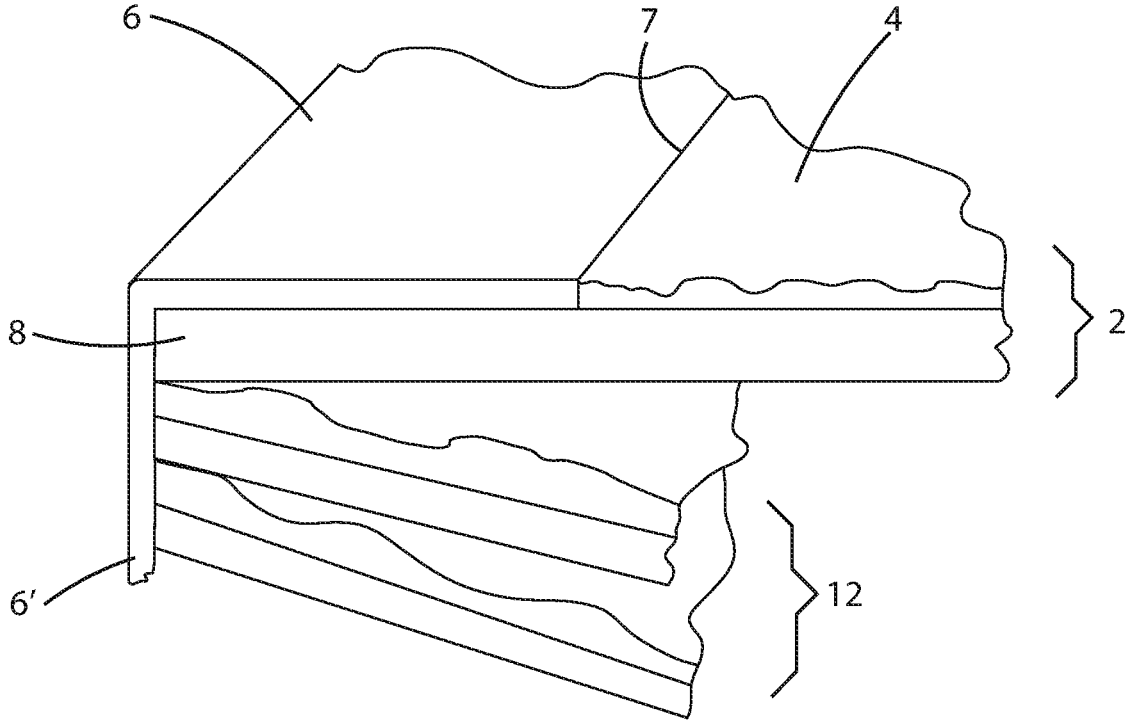
FIG. 1*b* is a detailed view of the embodiment of FIG. 1*a;*

FIG. 1*b* shows a detailed view of the edge of front cover portion 2 and binding layer 6. Front cover portion 2 is formed from a front base layer 8 and front decorative layer 4. Front decorative layer 4 is adhered to the top surface of base layer 8. Decorative layer 4 extends from the free edge of the front cover 2 across the base layer. Decorative layer 4 ends a distance from the bound edge of the front cover 2. According to one embodiment, the decorative layer 4 ends a distance equal to at least one thickness of the EVA foam forming the binding layer 6 from the bound edge of layer 8, typically at least 0.08". According to a preferred embodiment, the decorative layer 4 ends between about ¼ inch and 2 inches from the bound edge of layer 8. According to a more preferred embodiment, the decorative layer 4 ends between about ⅜ inch and 1 inch from the bound edge of layer 8. According to a most preferred embodiment, decorative layer 4 ends about ¾ inch from the bound edge of layer 8. Binding layer 6 abuts the edge of decorative layer 4 along an abutment 7 on the surface of layer 8. The edges of layers 6 and 4 may be affixed to one another by, for example, gluing. According to one embodiment, abutment 7 is a straight line parallel with the bound edge of base layer 8. According to another embodiment, abutment 7 is curvilinear.

The abutting relationship of the decorative layer 4 and binding layer 6 is particularly advantageous in the field of foam books, which are typically handled by young children. Because the layers abut, there is no loose edge of either the binding layer 6 or decorative layer 4 along the top of the book. According to one embodiment of the disclosure, the thicknesses of decorative layer 4 and binding layer 6 are about equal with each other. This further reduces the opportunity for a child to grasp the foam material and tear it from the book. Alternative configurations of a binding layer that overlies the top surface of known foam books leave an exposed edge that a child could potentially grasp or bite on and pull away from the front cover and tear a piece of material from the book. A book according to the present disclosure may have improved durability compared with such known foam books.

Binding layer 6 extends from the front cover where it abuts the front decorative layer 4, along the spine of the book 6', and across the back surface of the book. As shown in FIG. 1*a*, the back cover of the book 1 is formed by a back cover base layer 10 that extends from the spine portion 6' of the binding layer 6 to a free edge of the back cover base layer 10. A rear cover portion 6" of binding layer 6 covers the back, rear surface of back cover base layer 10. According to one embodiment, the rear cover portion 6" of binding layer 6 extends to the free edge of rear cover base layer 10. According to an alternative embodiment shown in FIGS. 4*a* and 4*b*, binding layer 6 abuts a rear decorative layer 5 on the rear surface of rear cover base layer 10 along abutment 7' in a manner similar to how the front decorative layer 4 abuts the binding layer 6 on the front surface of the book.

According to one embodiment of the disclosure, front base layer 8, rear base layer 10 and/or pages 12 (discussed below) are formed from one or more layers of foam material. Providing multiple layers of foam may provide advantageous physical properties, for example, by increasing stiffness, providing addition portions with contrasting colors or textures, or providing a desired tactile feel to the book.

Figure 2A:
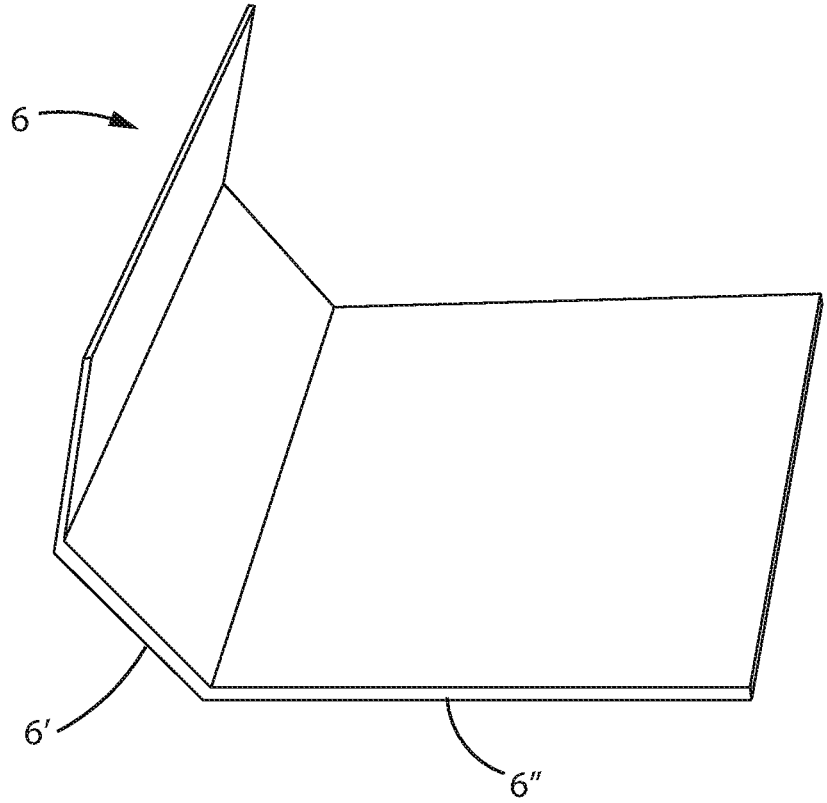
FIGS. 2*a-d* are exploded views showing a method of assembling a foam book according to an embodiment of the disclosure.
Figure 2B:
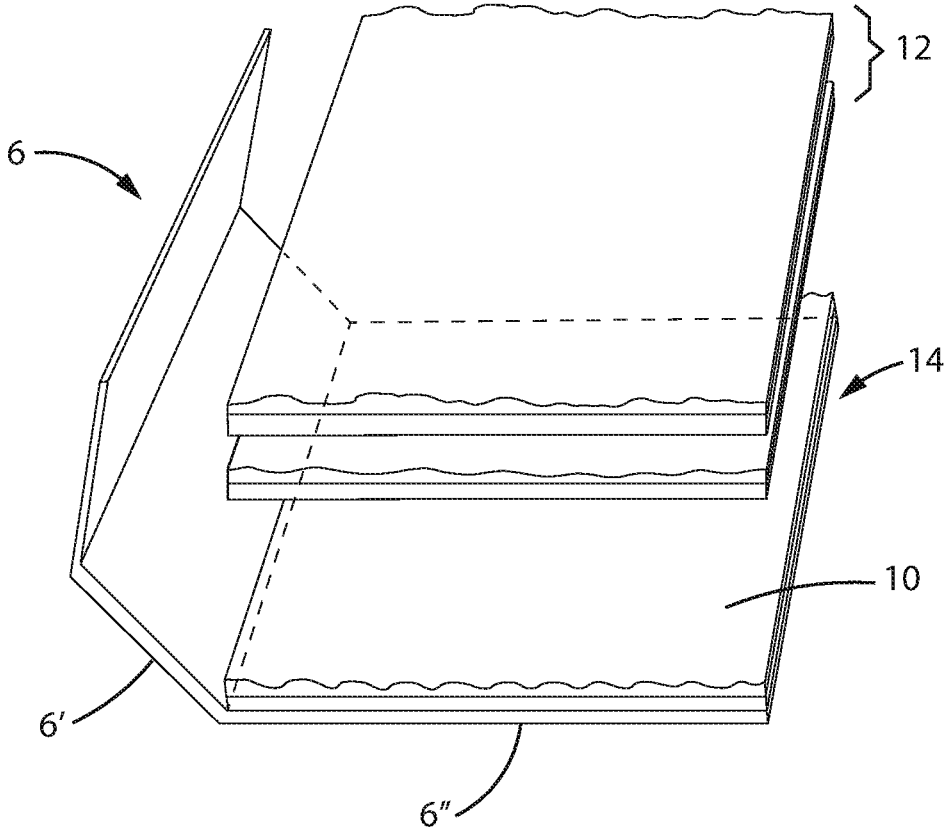

FIGS. 2*a-d* show the construction of a foam book according to an embodiment of the disclosure. As shown in FIG. 2*a*, a binding layer 6 is cut to size and decorations and/or textured embossments may be applied. Rear cover base layer 10 is attached to the face of binding layer 6. These layers may be attached with one another by various methods known in the field of the disclosure, including but not limited to providing a chemical or hot-melt adhesive between the layers. FIG. 2*b* shows rear cover base layer 10 attached to the rear portion 6" of binding layer 6. According to one embodiment, the free edge of rear cover base layer 10 is aligned with the free edge of binding layer 6 and the sides of layer 10 are aligned with the side edges of binding layer 6. By avoiding an overhang of the binding layer 6 beyond the edges of layer 10, the risk that a child can grasp or bite onto a portion of the binding layer 6 and tear it off is reduced. According to an alternative embodiment, the edges of binding layer 6 do extend past the edges of layer 10.

Figure 2C:
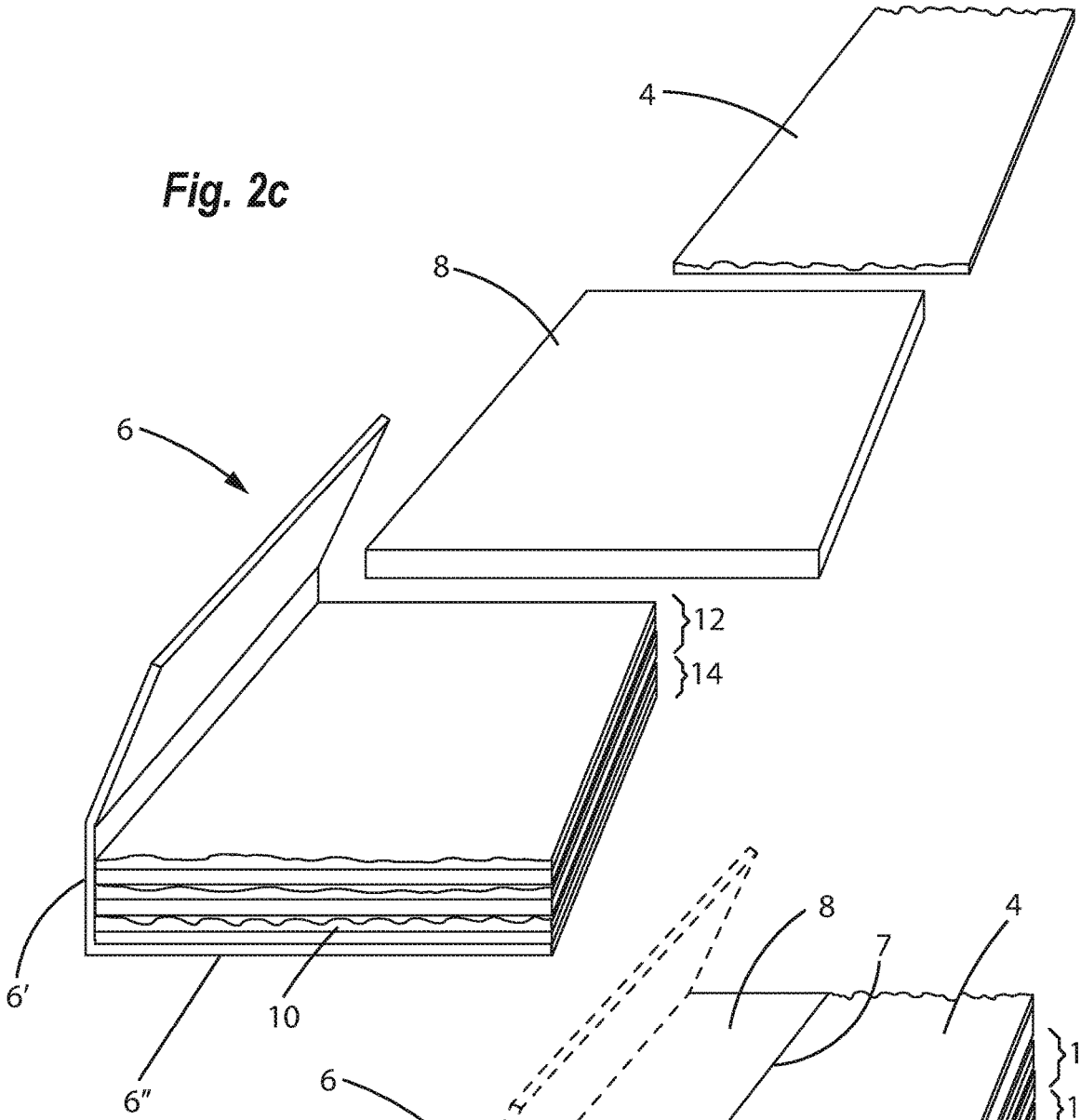

As shown in FIG. 2*b*, pages 12 are added to the book and a front cover base layer 8 is added atop the stack of pages 12. Pages 12 may be assembled separately with decorations and/or texturing applied by, for example, heat transfer printing, as will be described below. As shown in FIG. 2*c*, the free edges of pages 12 are aligned with the free edge of rear cover base layer 10. The edges of pages 12 opposite the free edge are connected with binding layer 6 along spine portion 6' by a technique known in the field of the disclosure, for example, by applying an adhesive between the edges of the pages 12 and the binding layer 6.

Figure 2D:
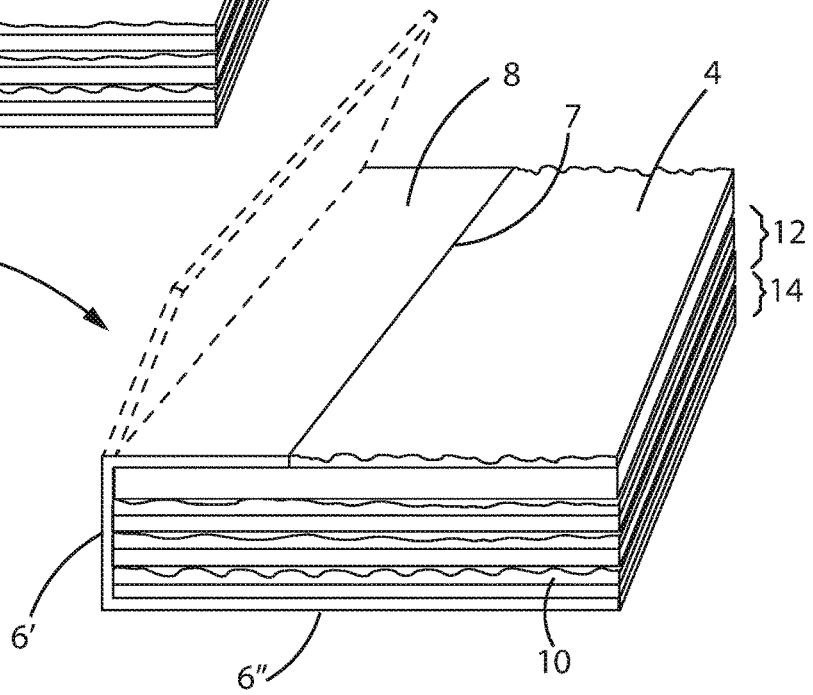

Front cover base layer 8 is attached to front decorative layer 4, as shown in FIGS. 2*c* and 2*d*. Again, these layers may be connected using any of a variety of techniques know in the field of the disclosure. As shown in FIG. 2*d*, binding layer 6, which has been adhered to the rear cover base layer 10 and the edges of pages 12, is connected with the front cover base layer 8 along a portion of the front cover base layer 8 that is not covered by front cover decorative layer 4. Layers 4 and 6 abut one another along abutment 7 so that no exposed edge of the decorative layer 4 and binding layer 6 is formed. Adhesive is applied along abutment 7 to further secure the edges of layers 4 and 6.

Figure 3A:
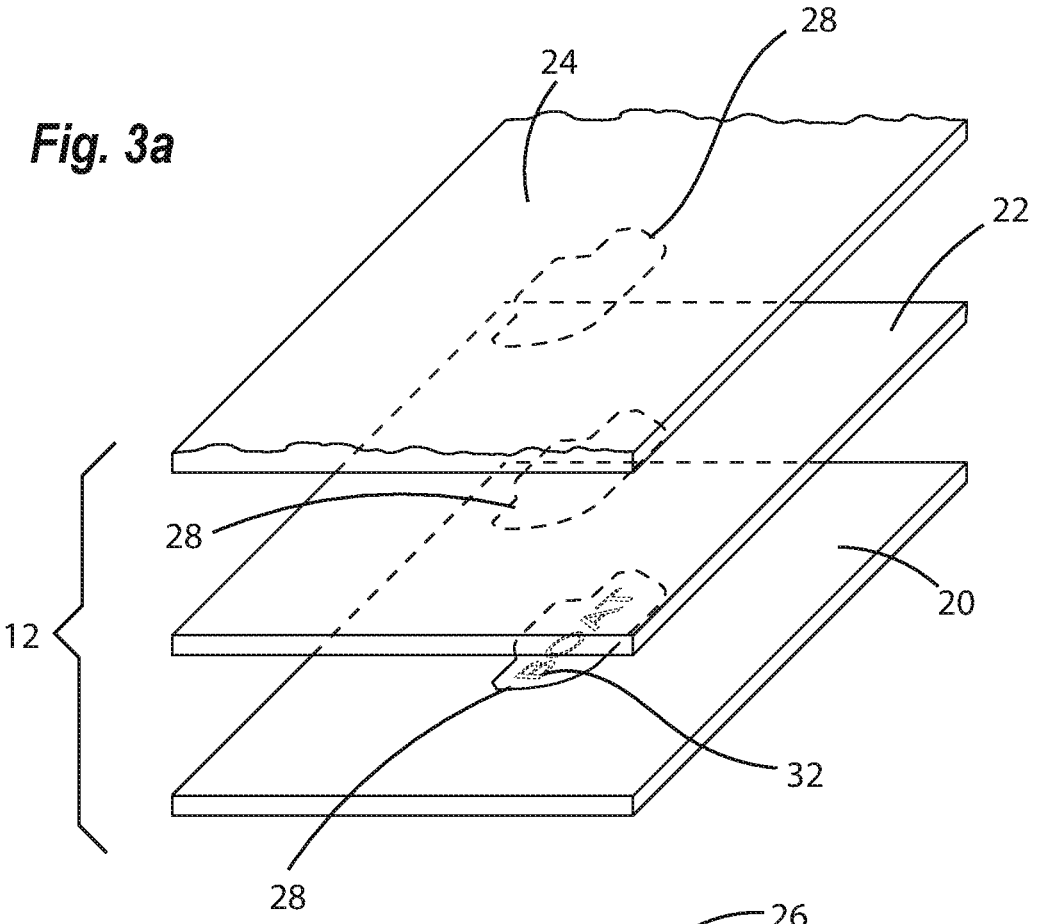
FIG. 3*a* is an exploded view of a page of a foam book according to an embodiment of the disclosure.
Figure 3B:
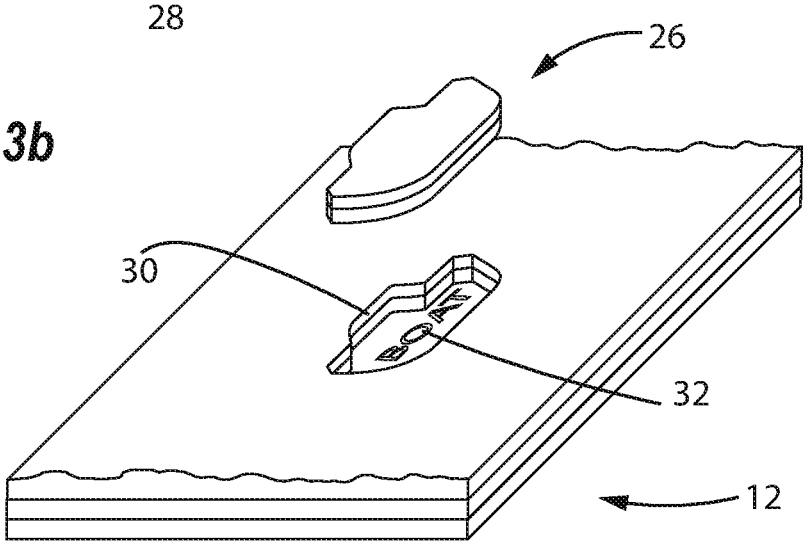
FIG. 3*b* shows a perspective view of a page, including a cut-out region according to an embodiment of the disclosure.

As shown in FIGS. 3*a* and 3*b*, pages 12 may be formed from one or more layers of foam material, such as EVA foam. According to a further embodiment, pages 12 are formed from a page base layer 20 and a page decorative layer 24. According to a further embodiment, a core layer 22 is disposed between layers 20 and 24. FIGS. 3*a* and 3*b* show an embodiment of a page 12 formed using three layers of foam material. A greater number of layers can be used to form the pages. Alternatively, core layer 22 and/or page decorative layer 24 may be eliminated so that page 12 is formed from one or two layers of material.

Page decorative layer 24 may include embossments on its surface to provide a pleasing tactile feel and/or printed artwork. The materials used to form layers 20, 22, and 24 may be selected to have different mechanical characteristics from one another and/or from the layers used to form the front and rear covers. For example, page base layer 20 and/or page core layer 22 may be formed from a relatively stiff material, such as an EVA foam with a greater hardness than the other layers to create a stiff page, while page decorative layer 24 may be formed from a softer foam material to provide a more appealing tactile feel on the surface of the page.

In addition to layers of foam, other materials may comprise portions of the pages and covers. For example, all or a portion of the surfaces may be covered with a smooth polymer applied by heat transfer printing. This may provide contrasting textures for different portions of the book.

According to the embodiment shown in FIGS. 3*a* and 3*b*, page 12 may include a cut-out portion 26. In this embodiment, layers 24 and 22 are cut along a line 28 to form a shape. In the region within the cut line 28, layers 22 and 24 are adhered to one another but layer 22 is not adhered to layer 20 in the cut-out region 26. This arrangement allows cut-out 26 to be removed from the page leaving a hole 30, for example, by a child playing with the book. The size and shape of cut-out 26 may be selected to represent an object, e.g., a boat, a train, and airplane etc., or an animal, e.g., a fish, a horse, etc.

The cut-out portion 26 is shaped to provide an interference fit within hole 30 so that it is removably retained within hole 30 until it is grasped by a user of the book and removed. According to one embodiment, the shape of line 28 surrounding cut-out portion 26 is selected to provide improved durability. The edge of cut-out portion 26 is formed from a plurality of linear and/or curvilinear segments. The angles between the segments and minimum radii of curvature of the segments is selected so that portions of the cut-out portion 26 are less likely to be grasped and torn from the cut-out portion. According to a preferred embodiment, angles between segments forming the edge of cut-out portion 26 are greater than or equal to 90 degrees.

According to one embodiment, layer 20 may include printing 32 in the hole 30, so that removing cut-out 26 reveals to text associated with the cut-out, for example, the word "boat" beneath a cut-out portion shaped like a boat. According to a further embodiment, cut-out portions are provided on the front cover portion 2 and/or rear cover portion 14. According to a further embodiment, all or a portion of the surface of the cut-out 26 includes printed artwork and/or an embossed textured surface that is distinct from the page decorative layer 24.

According to a further embodiment, line 28 forming the edge of hole 30 is at least one thickness of the EVA foam forming layer 24 away from any edge of page 12, typically at least 0.08". According to a more preferred embodiment, the minimum distance between the edge of hole 30 and the edge of the page is greater than about 5 mm. According to a most preferred embodiment, the minimum distance between the edge of hole 30 and the edge of the page is equal to or greater than about 10.5 mm. Providing a sufficient minimum area outside of hole 30 where layers 20, 22, and 24 overlap strengthens the bond between the layers and improves the durability of the book. This makes the foam layers more resistant to being grasped by a child and torn from the book.

While illustrative embodiments of the disclosure have been described and illustrated above, it should be understood that these are exemplary of the disclosure and are not to be considered as limiting. Additions, deletions, substitutions, and other modifications can be made without departing from the spirit or scope of the disclosure. Accordingly, the disclosure is not to be considered as limited by the foregoing description.

We claim:

1. A book comprising:

a front cover, wherein the front cover comprises a front base layer and a front decorative layer, wherein the front base layer comprises a first front face portion, a second front face portion, and a front free edge, and wherein the front decorative layer is adhered on the second front face portion;

a rear cover, the rear cover having a rear base layer and a rear free edge; and a binding layer, the binding layer extending across the rear base layer and along the first front face portion of the front base layer, wherein the binding layer is adhered with the rear base layer and the first front face portion, wherein the front decorative layer extends from the front free edge and across the second front face portion and abuts the binding layer, wherein the binding layer has a binding layer thickness where the binding layer extends along the first front face portion, wherein the front decorative layer has a front decorative layer thickness, and wherein the binding layer thickness is substantially equal to the front decorative layer thickness, and wherein the abutment of the binding layer and the front decorative layer forms a continuous surface.

2. The book of claim 1, further comprising one or more pages disposed between the front and rear covers, the pages each including respective page base layers and each respective page base layer including a page binding edge, wherein the page binding edge is connected with the binding layer.

3. The book of claim 2, wherein the pages further comprise a page surface layer and a page core layer, wherein the page core layer extends across a face of the page base layer, and wherein the page surface layer extends across a face of the page core layer opposite the page base layer.

4. The book of claim 3, wherein the page surface layer is textured.

5. The book of claim 3, wherein at least one page further comprises a cut region, the cut region formed through the page surface layer and page inner layer, wherein the cut region is removable from the page, and wherein the page base layer adjacent the cut region is intact, whereby the page base layer prevents the cut region from falling through the page.

6. The book of claim 5, wherein the cut region is formed by a cut line extending continuously around a periphery of the cut region, wherein the cut line is formed by a plurality of linear regions, curvilinear regions, and combinations thereof.

7. The book of claim 5, wherein the page surface layer has a surface layer thickness and wherein a minimum distance between an edge of the cut region and an edge of the page surface layer is greater than the surface layer thickness.

8. The book of claim 5, wherein printing is applied to the page base layer on a portion of the page base layer facing the cut region and wherein the cut region obscures the printing when the cut region is not removed.

9. The book of claim 3, wherein one or more of the page core layer and the page surface layer are connected to the binding layer along the page binding edge.

10. The book of claim 1, wherein the front cover further comprises a front core layer, the front core layer disposed between the front decorative layer and the front base layer.

11. The book of claim 1, wherein the rear cover further comprises a rear core layer, the rear core layer disposed between the rear base layer and the binding layer.

12. The book of claim 2, wherein at least one of the front cover, the rear cover, the binding layer, and the one or more pages is formed from a foam material.

13. The book of claim 12, wherein the foam material comprises an elastomer.

14. The book of claim 13, wherein the elastomer comprises one or more of ethylene vinyl acetate (EVA), polyurethane, polyethylene, silicone, nitrile rubber, neoprene, and natural latex.

15. The book of claim 2, wherein edges of the front cover, the rear cover, and the one or more pages are aligned with one another.

16. The book of claim 1, wherein the binding layer has a first textured surface facing outward of the book and the front decorative layer has a second textured surface facing outward of the book, and wherein textures of the first and second texture surfaces are different.

17. A book comprising:

a front cover, wherein the front cover comprises a front base layer and a front decorative layer, wherein the front base layer comprises a first front face portion, a second front face portion, and a front free edge, and wherein the front decorative layer is adhered on the second front face portion;

a rear cover, the rear cover having a rear base layer and a rear free edge;

a binding layer, the binding layer extending across the rear base layer and along the first front face portion of the front base layer; and one or more pages disposed between the front and rear covers, the pages each including respective page base layers and each respective page base layer including a page binding edge, wherein the page binding edge is connected with the binding layer, wherein the binding layer is adhered with the rear base layer and the first front face portion, wherein the front decorative layer extends from the front free edge and across the second front face portion and abuts the binding layer, wherein the pages further comprise a page surface layer and a page core layer, wherein the page core layer extends across a face of the page base layer, wherein the page surface layer extends across a face of the page core layer opposite the page base layer, wherein at least one page further comprises a cut region, the cut region formed through the page surface layer and page inner layer, wherein the cut region is removable from the page, wherein the page base layer adjacent the cut region is intact whereby the page base layer prevents the cut region from falling through the page, and wherein the page surface layer has a first texture and the cut region has a second texture, and wherein the first and second textures are different.

* * * * *